United States Patent [19]

Baugh

[11] Patent Number: 4,750,563

[45] Date of Patent: Jun. 14, 1988

[54] SLIP GRIPPING MECHANISM WITH AUTOMATIC SEGMENT ALIGNMENT

[75] Inventor: John L. Baugh, Huntsville, Tex.

[73] Assignee: Hughes Tool Company, Houston, Tex.

[21] Appl. No.: 77,566

[22] Filed: Jul. 24, 1987

[51] Int. Cl.[4] ..... E21B 23/00

[52] U.S. Cl. ..... 166/382; 166/216

[58] Field of Search ..... 166/382, 216, 217, 209, 166/208, 210, 215, 240, 138, 139, 134; 188/67

[56] References Cited

U.S. PATENT DOCUMENTS

| | | | |
|---|---|---|---|
| 2,108,605 | 2/1938 | Moseley | 166/216 |
| 2,373,880 | 4/1945 | Driscoll | 166/216 X |
| 2,751,017 | 6/1956 | Baker et al. | 166/216 |
| 2,877,850 | 3/1959 | Burns | 166/124 |
| 2,879,851 | 3/1959 | Wilson et al. | 166/216 |
| 3,013,610 | 12/1961 | Conrad | 166/134 |
| 3,191,684 | 6/1965 | Pittman et al. | 166/216 |
| 3,528,500 | 9/1970 | Brown | 166/212 |
| 4,311,196 | 1/1982 | Beall et al. | 166/134 |
| 4,437,517 | 3/1984 | Bianchi et al. | 166/120 |
| 4,440,223 | 4/1984 | Akkerman | 166/217 |
| 4,496,000 | 1/1985 | Weeks | 166/216 X |
| 4,598,774 | 7/1986 | Nevels et al. | 166/382 |

*Primary Examiner*—Stephen J. Novosad

*Attorney, Agent, or Firm*—Charles D. Gunter, Jr.

[57] ABSTRACT

A slip gripping mechanism is shown for supporting a string of cylindrical conduit within the interior bore of a circumscribing well conduit. A cone retaining ring engages a plurality of floating cone segments which define spaced longitudinal slots on the outside of the cylindrical conduit. Vertically shiftable slips are carried in spaced-apart fashion on the cylindrical conduit and have side edges adapted to engage mating profiles formed in the slots. The slots form guideways for the slips for shifting the slips upwardly and outwardly between a set position engaging the circumscribing conduit and an unset position. Selected ones of the slips and cone segments are tapered to index the slips and facilitate alignment within the slots as the slips are brought into contact with the cones during the setting operation.

13 Claims, 4 Drawing Sheets

SLIP GRIPPING MECHANISM WITH AUTOMATIC SEGMENT ALIGNMENT

BACKGROUND OF THE INVENTION

1. Cross Reference to Related Applications

The present application is related to the pending application of John L. Baugh, et al, Ser. No. 06/876,515, filed June 20, 1986, entitled "SLIP GRIPPING MECHANISM", now U.S. Pat. No. 4,711,326, and to the pending application of Sidney Kenneth Smith, Jr., Ser. No. 077,559, entitled "SLIP GRIPPING MECHANISM WITH FLOATING CONE SEGMENTS", filed concurrently herewith.

2. Field of the Invention

This invention relates to improvements in well tools of the type having slip assemblies for grippingly engaging surrounding cylindrical conduits.

3. Description of the Prior Art

Slip assemblies for well packers and liner hangers are actuated in order to support a conduit within the cased bore of a well. Prior art slip gripping mechanisms have generally included a plurality of wedge-shaped slip elements carried in circumferentially spaced-apart relation about a generally conically shaped expander surface on the tool body. More particularly, the lower surface portions of the slips are slidable over complimentary surfaces on the expander so as to cause teeth on the upper surfaces of the slips to be moved between expanded and contracted positions in response to relative axial movement of the slip elements and expander. This relative movement can be induced hydraulically or by mechanical actuation of telescopingly arranged, axially reciprocal members of the tool to which the slips and expanders are connected.

One disadvantage in the prior art gripping mechanisms lies in the fact that the loading imposed by the cylindrical conduit is transmitted radially from the expanders to the slips and radially into the surrounding well casing. At times, the loading can cause the casing to burst.

Prior arts slip gripping mechanisms have generally formed a part of a special hanger body or sub which included an internal mandrel that required consideration in determining the maximum support load of the tool. The hanger body was usually manufactured from special high strength material which differed from the material of the remainder of the cylindrical conduit being supported in the well bore.

The present invention has as its object the provision of a slip gripping mechanism for supporting a string of conduit within the interior bore of a circumscribing conduit which distributes the load being supported in a circumferential direction, rather than imposing a radial load.

Another object of the invention is the provision of a slip gripping mechanism which can be received upon the exterior surface of a standard string of cylindrical conduit and which does not require the presence of a special sub or hanger body within the string.

Another object of the invention is the provision of a unique slip and cone gripping arrangement which include floating cone segments that allow the metal of the gripping mechanism to flex more equally, thereby reducing stress build-up during high load applications and consequently reducing the chance of permanent deformation of the slip and cone components of the mechanism.

Another object of the invention is the provision of a gripping mechanism in which the slips are separated from the cones by a predetermined distance as the device is run into the well bore to allow reciprocation and rotation of the pipe string prior to setting the gripping mechanism.

Additional objects, features and advantages will be apparent in the written description which follows.

SUMMARY OF THE INVENTION

The slip gripping mechanism of the invention is used for supporting a string of cylindrical conduit within the interior bore of a circumscribing conduit in a well bore. The gripping mechanism includes a cone retaining ring which is supported in the string of cylindrical conduit. Preferably, the cone retaining ring has an internal bore which is sized to slidingly receive the cylindrical external diameter of one of the joints of the cylindrical conduit which is to be supported from the circumscribing conduit, whereby the cone retaining ring is received directly on the cylindrical external diameter of the cylindrical conduit.

The gripping mechanism also includes a plurality of individual cone segments. Each cone segment has a forward end, side edges with lower edge surfaces and an engagement end. The engagement end is adapted to be engaged by the cone retaining ring for supporting each of the cone segments in spaced circumferential locations. The side edges of adjacent cone segments define a plurality of circumferentially spaced, longitudinally disposed slots when the cone segments are received on the exterior of the cylindrical conduit.

A plurality of circumferentially spaced, vertically shiftable slips are carried on the cylindrical conduit and are initially spaced-apart from the cone segments. Each slip has a forward end, side edges and an engagement end. The side edges are adapted to engage mating profiles formed in the longitudinally disposed slots. When the slips are brought into contact with the cone segments, the mating profiles comprise converging ramp surfaces which present a tapered incline in the range of about 2 to 10 degrees with the respect to the slot lower edge surfaces whereby the slots form guideways for the slips for shifting the slips upwardly and outwardly between a set position engaging the circumscribing conduit and an unset position.

Each slip has an arcuate lower surface as defined radially from the longitudinal axis of the cylindrical conduit. An imaginary center line can be drawn which bisects the lower surface longitudinally. The lower surface center line is disposed above the cylindrical conduit exterior surface in both the set and unset positions, wherein movement of the slips upwardly and outwardly relative to the cone segments within the longitudinally disposed slots serves to impose circumferential loading upon the adjacent cone segment side edges.

Preferably, at least one of the cone segment forward ends is tapered to a point. One or more of the slip forward ends is also tapered to facilitate alignment of the slips within the longitudinally disposed slots when the slips are brought into contact with the cone segments.

The above as well as additional objects, features, and advantages of the invention will become apparent in the following detailed description.

DESCRIPTION OF THE PREFERRED EMBODIMENT

Figure 1A:
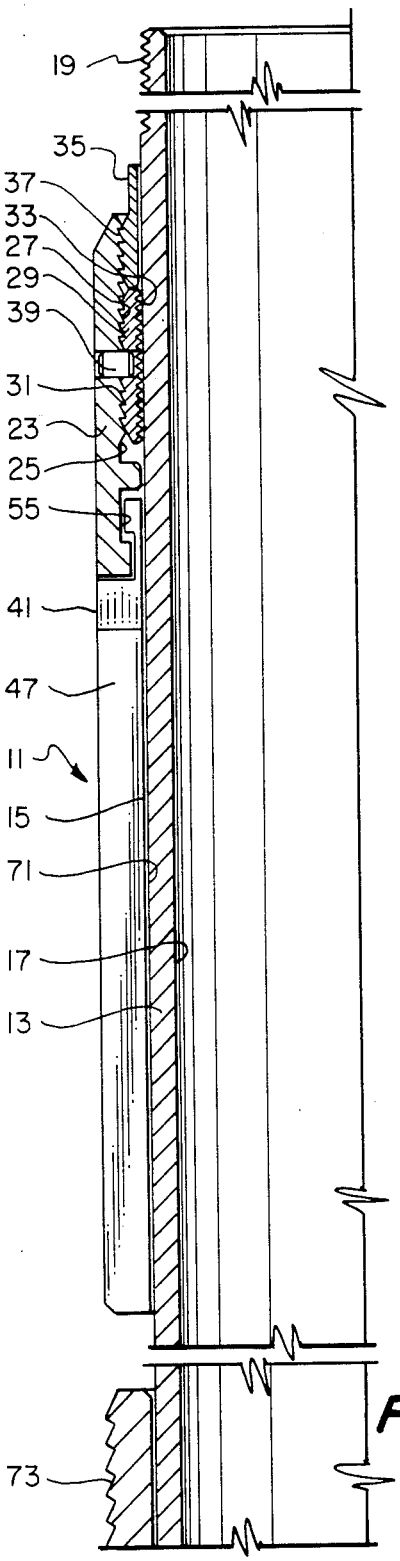
FIG. 1A is a side, cross-sectional view of the top portion of a gripping mechanism of the invention in the running-in position.

FIG. 1A shows the upper portion of a slip gripping mechanism of the invention designated generally as 11. The slip gripping mechanism 11 is used for supporting a string of cylindrical conduit, such as a liner, within the interior bore of a circumscribing conduit, such as the casing, in a well.

The gripping mechanism includes a central mandrel 13 having an exterior surface 15 and an internal bore 17. The central mandrel 13 also has an upper connecting end 19 and is engaged by a conventional running tool for funning the gripping mechanism into position within the well bore. One such commercially available running tool is shown, for instance, in U.S. Pat. No. 4,598,774, issued July 8, 1986, and assigned to the assignee of the present invention. Unlike prior gripping mechanisms, the central mandrel 13 can be a standard joint of cylindrical conduit identical to the joints of conduit in the remainder of the string which is to be supported in the well bore. An opposite connecting end 21 can be used to support the depending string of cylindrical conduit, such as a liner to be hung within a cased well bore.

The gripping mechanism includes a cone retaining body, such as ring 23 which has an internal bore 25. The bore 25 is sized to slidingly receive the cylindrical external diameter 15 of the joint of cylindrical conduit 13 which is to be supported from the circumscribing conduit (casing) whereby the cone retaining ring 23 is received directly on the cylindrical external diameter 15 between the threaded connecting ends 19, 21. It is not necessary that the cylindrical conduit 13 be made from special material or that it have a greater wall thickness than the cylindrical conduit in the remainder of the pipe string.

The cone retaining ring 23 can be secured against axial movement on the external surface 15 in any convenient manner. In the embodiment shown in FIG. 1A, the ring internal bore 25 is provided with an internal thread profile 27. A body lock ring 29 is located on the profile 27 and has an external thread profile 31 which engages the mating profile 27 of the retaining ring 23. The body lock ring 29 is also provided with a serrated lower surface 33 for gripping the external surface 15 of the cylindrical conduit 13. The body lock ring 29 is a cylindrically shaped member which is split at one point in the circumference thereof to allow inward, radial constriction as the thread profile 31 moves over the internal thread profile 27 of the cone retaining ring 23.

The mechanism also includes a nut 35 having an external thread profile 37 which engages the internal thread profile 27 of the retaining ring 23. As the nut 35 moves down the thread profile 27 in the direction of the body lock ring 29, the body lock ring profile 31 moves down the thread profile 27 resulting in inward radial movement of the serrated surface 33. This inward radial movement causes the serrated surface 33 to grip the exterior surface 15 of the central mandrel 13. One or more set screws 39 can then be used to fix the ring on the external surface 15.

Figure 2:
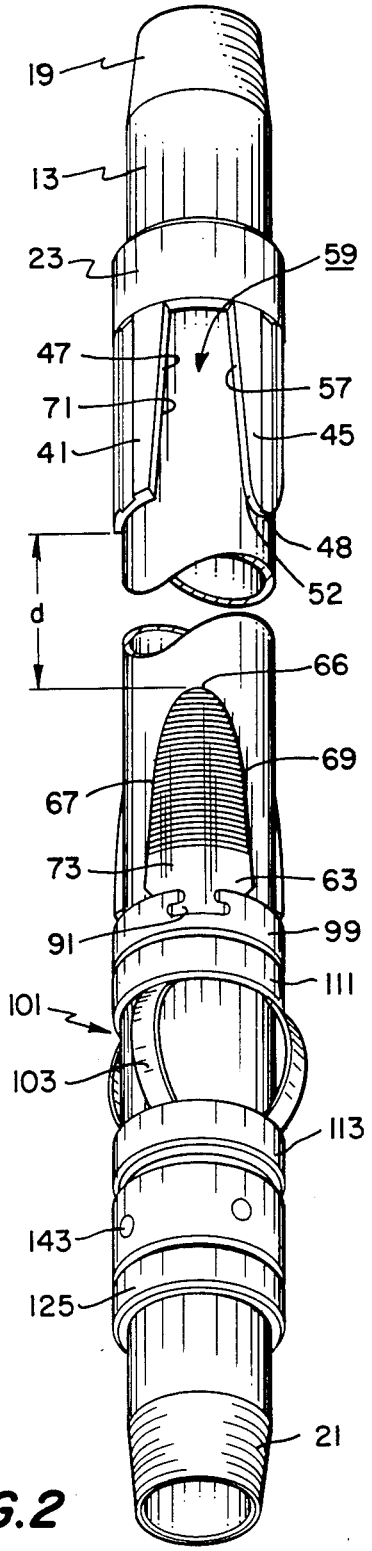
FIG. 2 is a profile, perspective view of the slip gripping mechanism of the invention in the unset position.
Figure 3:
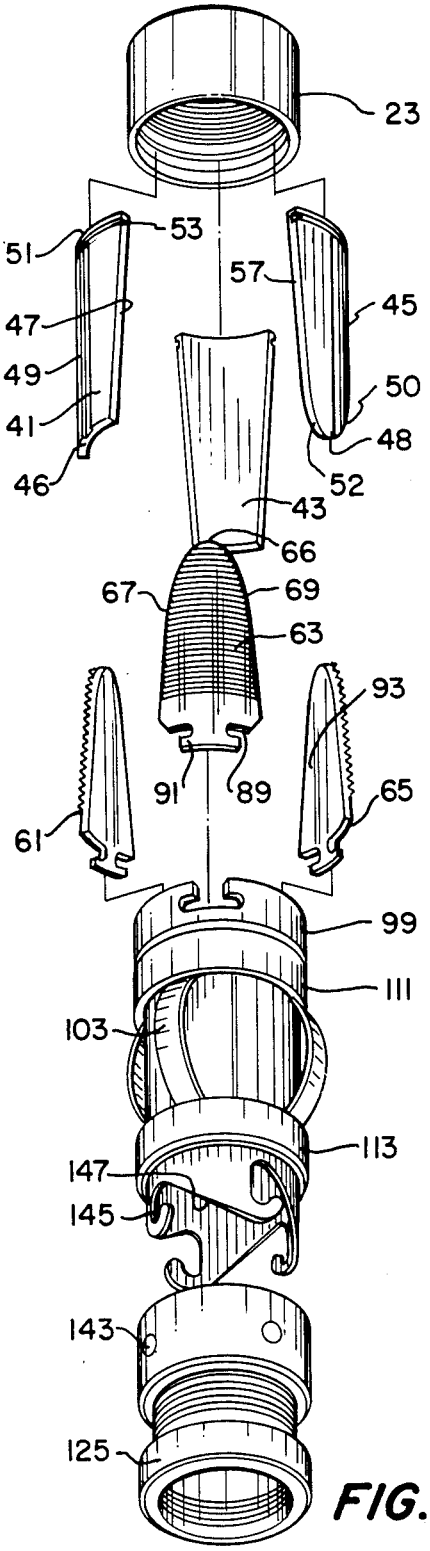
FIG. 3 is an exploded view of the mechanism of FIG. 2 showing the floating cone segments and the gripping slips.

As shown in FIGS. 1A, 2 and 3, a plurality of individual, floating cone segments 41, 43, 45 are engaged by the cone retaining ring 23. Each of the cone segments has a forward end 46, side edges 47, 49 and an engagement end 51. The engagement end 51 can be provided with a groove 53 which is engaged within a mating recess (55 in FIG. 1A) whereby the cone segments are supported in spaced, circumferential locations on the external surface 15 of the cylindrical conduit 13. As shown in FIG. 2, the side edges 47, 57 of adjacent cone segments 41, 45 along with the ring 23 define a plurality of circumferentially spaced, longitudinally disposed slots 59 with respect to the exterior surface 15. Also, as shown in FIGS. 2 and 3, at least one of the cone segments 45 has a tapered forward end 48. Preferably, the end 48 is tapered to a point defined by two intersecting surfaces 50, 52 which diverge at angles of approximately 45 degrees from the point.

Figure 5:
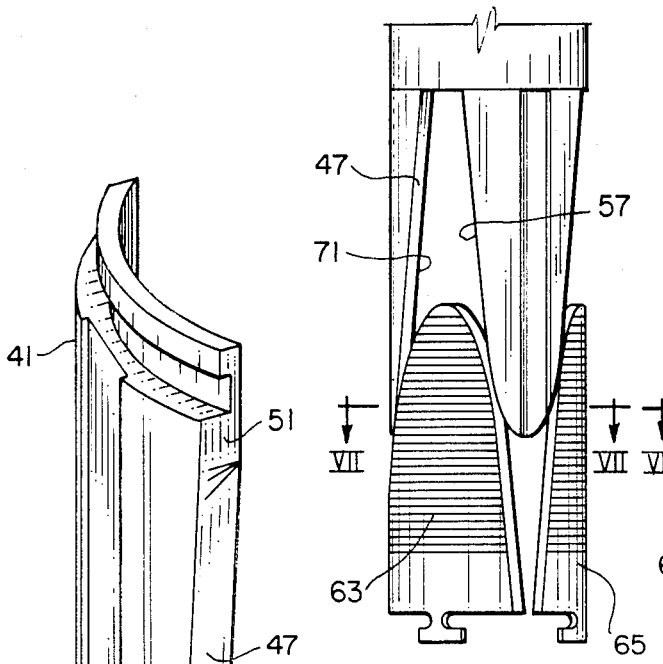
FIG. 5 is an isolated view of the slip and cone segments of the gripping mechanism in the unset position.
Figure 6:
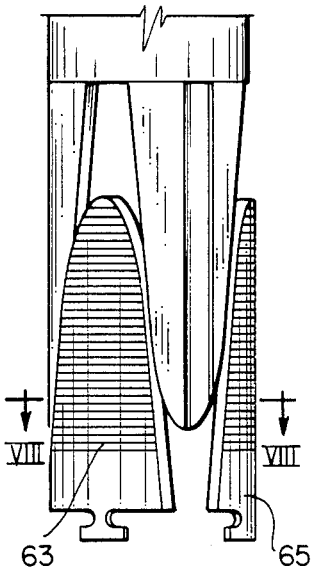
FIG. 6 is a view similar to FIG. 5 showing the slip and cone segments in the set position.

A plurality of circumferentially spaced, vertically shiftable slips 61, 63, 65 are carried on the cylindrical conduit 13 and are initially spaced-apart from the cone segments 41, 43, 45 (see FIG. 2). Each slip has a forward end 66 and side edges 67, 69 which engage mating profiles formed in the longitudinally disposed slots when brought into contact with the cone segments, whereby the slots form guideways for the slips 61, 63, 65 for shifting the slips upwardly and outwardly between an unset position, as shown in FIG. 5 and a set position, as shown in FIG. 6, engaging the circumscribing conduit. At least one of the slips 61, 63, 65 has a tapered forward end 66 which is tapered to a point similar to the point on the end of the cone segment 48. Preferably, all three slips 61, 63, 65 have tapered forward ends which together with the cone forward end 48 comprise indexing means to facilitate alignment of the slips within the longitudinally disposed slots 59.

Figure 4:
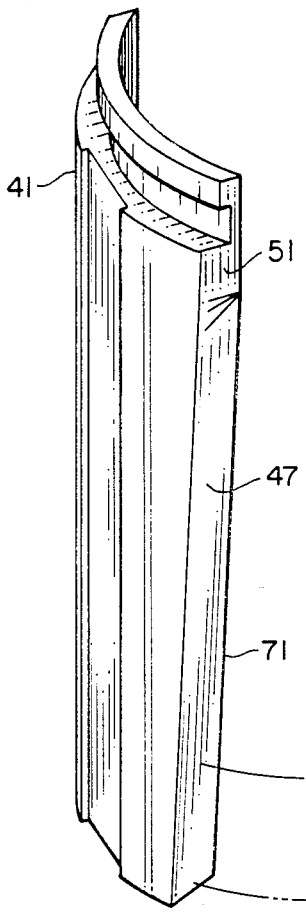
FIG. 4 is a close-up view of an individual slip and cone segment showing the mating ramp surfaces thereof.
Figure 4:
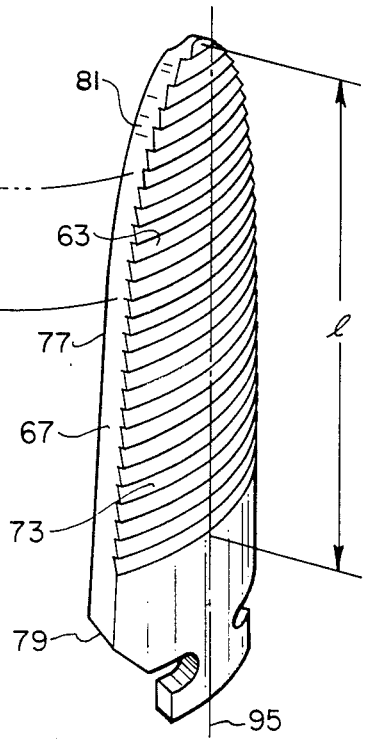

As shown in FIGS. 2, 5 and 6, the slot profiles 47, 57 comprise converging ramp surfaces which present a tapered incline or "ramp angle" which is preferably in the range from about 2 to 10 degrees with respect to the slot lower edge surface 71. As a result, any upward vertical travel of the slip 63 within the slot 59 results in outward radial movement of the slip upper surface 73. With reference to FIG. 4, it will be noted that the side edge 47 of the cone 41 is tapered to slant inwardly 2 to 10 degrees along the entire lower edge 71 from the engagement end 51 to the opposite end 75. The mating surface 67 of the slip 63 is also tapered to slant outwardly 2 to 10 degrees along the entire length of the lower edge surface 77 from the engagement end 79 to the opposite end 81 thereof. As the slips move from the unset position shown in FIG. 5 to the set position shown in FIG. 6, it is the mating side edges 47, 57 which provide the outward radial mvoement of the slips and which are loaded circumferentially during the slip actuation.

Each slip 61, 63, 65 has an engagement end 89 (FIG. 3) opposite forward end 66 which is preferably provided with a T-shaped connecting region 91. As shown in FIG. 3, each slip 65 has an arcuate lower surface 93 which forms a flow area with a respect to the external cylindrical surface 15 of the conduit 13. An imaginary center line 95 (FIG. 4) can be drawn which bisects the slip upper and lower surfaces 73, 93 longitudinally. The lower surface longitudinal line includes the point 97 in FIG. 8 which is disposed above the cylindrical conduit 13 exterior surface 15 in both the unset position of FIG. 7 and the set position illustrated in FIG. 8. In prior art slip gripping mechanisms, the lower surface 93 generally contacted the expander surface of the hanger body for shifting the slip upwardly and radially outwardly with respect to the hanger body.

Figure 1B:
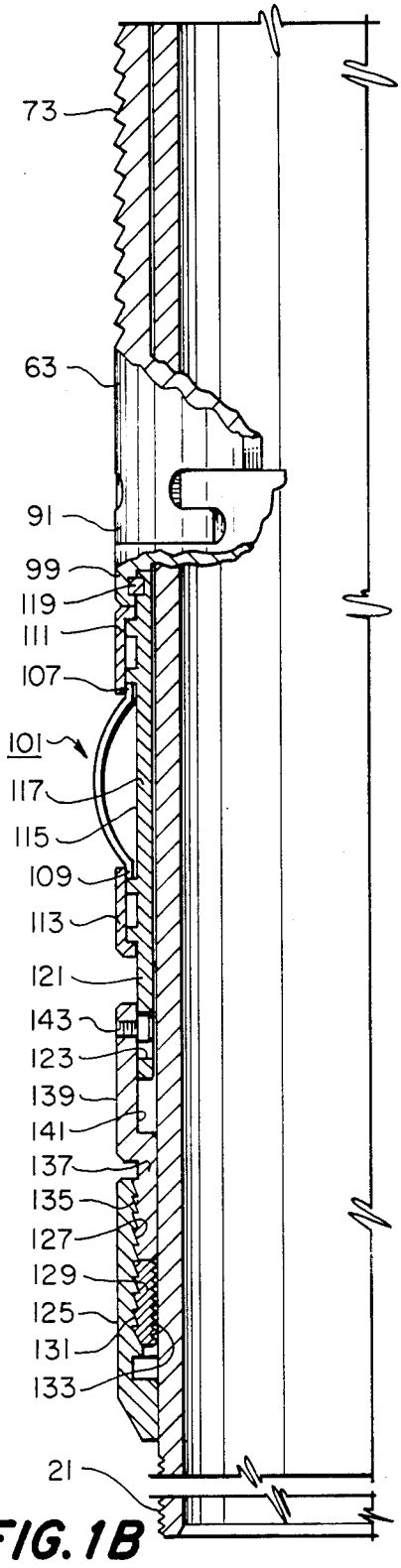
FIG. 1B is a downward continuation of the tool of FIG. 1A.

As shown in FIGS. 1B and 2, the slip T-shaped connecting regions 91 are received within mating openings provided in a slip retaining ring 99. The retaining ring 99 forms the upper extent of a drag spring assembly 101. The drag spring assembly 191 has a plurality of drag springs 103 which bow outwardly from the central mandrel 13 and make frictional contact with the interior bore of the circumscribing conduit (105 in FIG. 7) as the gripping mechanism is run into position within the well bore. Each spring has an upper end 107 and a lower end 109 (FIG. 1B). The spring ends are engaged by upper and lower retaining rings 111, 113 respectively. The retaining rings 111, 113 are carried on the outer surface 115 of a cylindrical spring support 117 which surrounds the mandrel 13. The spring support 117 is connected at its upper extent to the slip retaining ring 99 by means of a square wire 119 received in a key way formed between the srping support 117 and the retaining ring 99. The spring support 117 also includes a downwardly extending lower extent 121 which surrounds the mandrel 13 and which is provided with helical shaped J-slots 123 (FIG. 3).

As shown in FIG. 1B, a make-up nut 125 is carried about the mandrel 13 below the drag spring assembly 101. A portion of the make-up nut is spaced apart from the mandrel exterior surface 15 and has an internal thread profile 127 similar to the thread profile 27 of the cone retaining ring 23. A body lock ring 129 is located on the interior thread profile 127 between the make-up nut 125 and the mandrel 13 and is provided with an external thread profile 131 which engages the mating profile 127. The body lock ring 129 also has a lower serrated surface 133 for gripping the mandrel exterior, in the same manner as body lock ring 29.

The internal thread profile 127 of the make-up nut engages an external thread profile 135 of an actuating sleeve 137. Movement of the make-up nut 125 up the external profile 135 results in inward radial movement of the body lock ring 129 whereby the serrated surface 133 grips the exterior surface 15 of the mandrel 13. This fixes the sleeve 137 against axial travel with respect to the mandrel 13. The actuating sleeve 137 has an upper extent 139 which is spaced apart from the mandrel exterior to form an annular recess 141. A J-pin 143 is mounted on the interior of the actuating sleeve 137 and extends radially inward into the annular recess 141 in the direction of the mandrel exterior 15. Preferably, a plurality of J-pins are located at spaced circumferential locations about the actuating sleeve and are received within mating recesses of the drag spring lower extent 121.

The operation of the device will now be described. As shown in FIG. 2, the gripping mechanism can be run into the well bore with the cone segments 41, 43, 45 spaced-apart from the slips 61, 63, 65 by a preselected distance "d". This distance will typically be on the order of 10 to 30 feet, depending upon the application. Where a liner is being cemented in a well bore, the distance "d" allows the operator to "rotate and reciprocate" the pipe string without danger of prematurely setting the slips. The slips are initially held in the position shown by a J-arrangement. As shown in FIG. 3, the J-slot 123 has an axial leg 145 which extends generally parallel to the longitudinal axis of the device, and an intersecting helical leg portion 147. The device is run into position in the well bore with the drag spring assembly and J-pin assembly as shown in FIG. 1B. The frictional engagement between the drag spring assembly 101 and the surrounding casing 105 causes the J-pin 143 to ride at the upper end of the axial leg 145. Once the desired depth has been reached in the well bore, the running tool and associated pipe string leading to the well surface is raised a few inches and turned to the right which allows the J-pin 143 to move down the helical portion 147 to unlatch the J-assembly. The operator can now pick up the pipe string, e.g. 15 feet and rotate and reciprocate as a part of other well bore operations. The running-in string can then be lowered causing the slips 61, 63, 65 to contact the cone segments. The tapered forward end 48 of the cone 45 "indexes" against the tapered forward end 66 of the slips to facilitate alignment of the forward end 66 of the slips within the slots 59. As the pipe string continues to be lowered the weight of the pipe string is transferred to the slips causing the slips to move from the retracted position to the extended gripping position shown in FIGS. 6 and 8.

Figure 7:
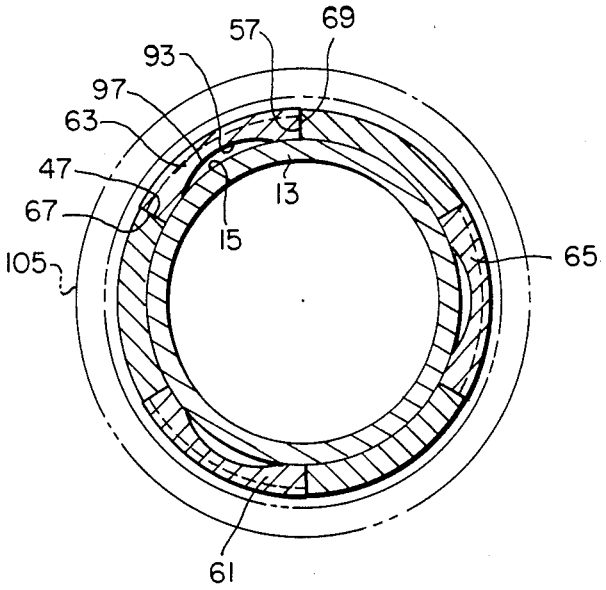
FIG. 7 is a cross-sectional view of the slip and cone segments taken along lines VII—VII in FIG. 5.
Figure 8:
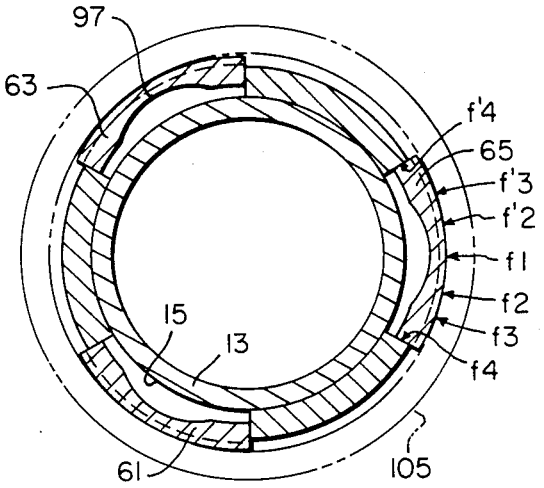
FIG. 8 is a cross-sectional view taken along Lines VIII—VIII in FIG. 6.

The slip dimensions are selected to allow controlled bending or flexing of the slip in the direction of the circumscribing conduit as the slip moves from the unset to the set position. As shown in FIGS. 7 and 8, the imaginary center line 95 which bisects the top arcuate surface 73 of the slip 63 defines the first area of contact with the surrounding casing during the setting step. This area is indicated by the area F1 in FIG. 8. As the setting operation continues, the slip flexes and contacts the surrounding casing at points F2, F2' followed by points F3, F3'. This action also results in force being exerted in a circumferential direction, indicated by arrows F4, F4'. In other words, the setting action of the present slip gripping mechanism results in a compressive circumferential loading on the adjacent cone segments 41, 43, 45. In prior art slip gripping mechanism, the setting load resulted in force being applied radially between the slip and the casing bore. By properly selecteing the slip dimensions and ramp angle, the slip will flex and conform to the shape of the casing interior bore without imposing burst loads upon the casing or collapse loads on the cylindrical conduit. The "floating" nature of the cones enables the slips to flex more equally and distributes the load more evenly about the gripping mechanism.

The slip gripping mechanism of the invention is designed to control the maximum load applied to the surrounding casing through the flexing actions of the slip. The thickness, width, contour, material, and condition of the slips are controlled to allow control of the loads imparted to the casing by the slips. If the maximum acceptable load on the casing is "P" (pounds per square inch) then the slip is designed to carry the maximum rated load without exceeding "P". As the load increases, the slip gripping mechanism allows the area of the slip in contact with the casing to increase without exceeding load "P". Length L (FIG. 6)×width indicated by F2' to F2×"P" indicates the maximum load which can be applied to the casing without damage. As the area in contact increases to L X F3' to F3×"P", the load which can be supported also increases. The flex of the slip can be controlled to be less than or equal to "P" up to the maximum rated capacity of the slip system. The cylindrical conduit 13 does not support any radial loads and is therefore eliminated from the hanger load limiting factors. The loads can be controlled for use with any casing or conduit grade from steel to plastic without damage to the conduit.

EXAMPLE

A slip gripping mechanism of the invention was tested in 9⅝" P-110 oil well casing having a weight/ft. of 53.5 lbs./ft. P-110 casing has a performance rating (P) of 10,900 lbs./sq. in. Each slip in the griping mechanism had a length (L) of 7 inches. The distance F2' to F2 was 2 inches and the distance F3' to F3 was 4 inches. The area in each slip in contact with the casing is 4×7=28 sq. in. The slip gripping mechanism utilized 3 slips mounted at 120 degree circumferential locations, as shown in FIGS. 1, 2, and 3. Thus there were 3 slips×28 sq. in.=84 sq. in. total slip area in contact with the surrounding casing. The calculated maximum load which can be supported by the casing is 84×10,900=915,600 pounds without damage to the casing. Using a 5 degree ramp angle, this translates into a vertical load capability of 364,000 pounds. In an actual test a 364,000 pounds load was applied to the slip gripping mechanism without damage to the casing.

Because of the flexing action of the slips in conforming to the shape of the circumscribing conduit, the gripping surfaces 73 can be designed as other than serrated surfaces. For instance, "hard facing" treatments can be applied to the metal surface 73 to provide a roughened surface capable of gripping the circumscribing conduit. Hard facing metal treatments are known to those skilled in the art. For instance, see U.S. Pat. No. 3,800,891 to WHITE, et al, issued Apr. 2, 1974 and U.S. Pat. No. 2,939,684 to PAYNE, issued June 7, 1960. Also, because of the unique action of the slip gripping mechanism, the gripping surface 73 can have a "soft facing" of a deformable nature, such as a layer of copper which would tend to assume the shape of any irregularity of the bore in the circumscribing conduit.

An invention has been provided with several advantages. The slip gripping mechanism can be quickly and easily installed on the exterior of a string of well tubing, casing or liner. The modular design eliminates the need for a separate liner hanger body or sub to be made up in the pipe string. This eliminates problems in matching threaded connectors in premium threaded pipe strings. It also eliminates the need for a hanger body made of a heavier walled, more expensive pipe material. Because of the unique circumferential loading action of the gripping mechanism, the support load is not imposed radially in toward the pipe. As a result, heavier loads can be supported without the danger of bursting the surrounding casing or the need to provide a heavy walled hanger body. The gripping mechanism of the invention can be provided in a shorter length and yet support heavier loads than prior art devices. The slip upper surface has a smaller radius than the circumscribing conduit diameter and the slip dimensions are selected to allow the slips to flex and conform to the diameter of the surrounding casing. The setting action begins with a line contact at the center of the slip upper surface with the contact moving out evenly on either side of the initial center line contact.

By providing the cone elements as floating segments, the metal is allowed to flex more equally, thereby reducing stress build-up during high load applications and reducing the chance of permanent deformation of the metal parts. By initially separating the slips form the cones by a distance of twenty feet or more, the operator can unjay, "reciprocate and rotate" without prematurely setting the slips.

While the invention has been described in only one of its forms, it should be apparent to those skilled in the art that it is not so limited, but is susceptible to various changes and modifications without departing from the spirit thereof.

I claim:

1. A slip gripping mechanism for supporting a cylindrical conduit within the interior bore of a circumscribing conduit in a well bore, comprising:

a cone retaining body received about the exterior of the cylindrical conduit;

a plurality of individual cone segments, each cone segment having a forward end, side edges and an engagement end, the engagement end being adapted to be engaged by the cone retaining body for supporting each of the cone segments in spaced circumferential locations on the cylindrical conduit, the side edges of adjacent cone segments defining a plurality of circumferentially spaced, longitudinally disposed slots;

a plurality of circumferentially spaced, vertically shiftable slips carried on the cylindrical conduit and initially spaced-apart from the cone segments, each slip having a forward end, side edges and an engagement end, the side edges being adapted to engage mating profiles formed in the longitudinally disposed slots whereby the slots form guideways for the slips for shifting the slips upwardly and outwardly between a set position engaging the circumscribing conduit and an unset position;

setting means for effecting opposite relative motion between the cone segments and the slips; and indexing means provided on a selected one of said cone segments and said slips to facilitate alignment of said slips within said longitudinally disposed slots upon actuation of said setting means.

2. A slip gripping mechanism for supporting a cylindrical conduit within the interior bore of a circumscribing conduit in a well bore, comprising:

a cone retaining body having an internal bore, the bore being sized to be slidingly received about the exterior of the cylindrical conduit;

a plurality of individual cone segments, each cone segment having a forward end, side edges and an engagement end, the engagement end being adapted to be engaged by the cone retaining body for supporting each of the cone segments in spaced circumferential locations on the cylindrical conduit, the side edges of adjacent cone segments defining a plurality of circumferentially spaced, longitudinally disposed slots, and at least one of the cone segment forward ends being tapered to a point;

a plurality of circumferentially spaced, vertically shiftable slips carried on the cylindrical conduit, each slip having a forward end, side edges and an engagement end, the side edges being adapted to engage mating profiles formed in the longitudinally disposed slots whereby the slots form guideways for the slips for shifting the slips upwardly and outwardly between a set position engaging the circumscribing conduit and an unset position, at least one of the slip forward ends being tapered to a point to facilitate alignment of the slips within the longitudinally disposed slots; and setting means for effecting opposite relative motion between the cone segments and the slips.

3. The slip gripping mechanism of claim 2, further comprising a slip retaining ring carried about the cylindrical conduit and engaging the slips, the cone retaining ring being fixed against axial movement on the cylindrical conduit and the slip retaining ring being connected to the setting means, whereby actuation of the setting means results in longitudinal travel of the slips relative to the cone segments.

4. The slip gripping mechanism of claim 3, further comprising:

a drag spring assembly having an upper extent which connects to the longitudinally movable slips and a lower extent, the drag spring assembly including a plurality of drag springs which bow outwardly from the central mandrel and make frictional contact with the interior bore of the circumscribing conduit as the gripping mechanism is run into position within the well bore; and an actuator sleeve removably mounted on the mandrel exterior below the drag spring assembly, a selected one of the drag spring assembly and the actuator sleeve being provided with a J-pin, the other of the drag spring assembly and the actuator sleeve being provided with a mating J-slot, whereby movement of the J-pin within the J-slot, controls the longitudinal movement of the slips between the retracted and the extended gripping position.

5. A slip gripping mechanism for supporting a string of cylindrical conduit within the interior bore of a circumscribing conduit in a well bore, comprising:

a cone retaining ring supported in the string of cylindrical conduit;

a plurality of individual cone segments, each cone segment having a forward end, side edges with lower edge surfaces, and an engagement end, the engagement end being adapted to be engaged by the cone retaining ring for supporting each of the cone segments in spaced circumferential locations, the side edges of adjacent cone segments defining a plurality of circumferentially spaced, longitudinally disposed slots, at least one of the cone segment forward ends being tapered to a point;

a plurality of circumferentially spaced, vertically shiftable slips carried on the cylindrical conduit, each slip having a forward end, an engagement end, and side edges adapted to engage mating profiles formed in the longitudinally disposed slots, whereby the slots form guideways for the slips for shifting the slips upwardly and outwardly between a set position engaging the circumscribing conduit and an unset position, at least one of the slip forward ends being tapered to a point to facilitate alignment of the slips within the longitudinally disposed slots;

setting means for effecting opposite relative motion between the cone segments and the slips; and wherein the cone segments are initially separated from the slips on the exterior of the cylindrical conduit by a distance at least equal to the length of the slips from the forward ends to the engagement ends thereof.

6. A slip gripping mechanism for supporting a string of cylindrical conduit within the interior bore of a circumscribing conduit in a well bore, comprising:

a cone retaining ring supported in the string of cylindrical conduit;

a plurality of individual cone segments, each cone segment having a forward end, side edges with lower edge surfaces, and an engagement end, the engagement end being adapted to be engaged by the cone retaining ring for supporting each of the cone segments in spaced circumferential locations, the side edges of adjacent cone segments defining a plurality of circumferentially spaced, longitudinally disposed slots, at least one of the cone segment forward ends being tapered to a point;

a plurality of circumferentially spaced, vertically shiftable slips carried on the cylindrical conduit, each slip having a forward end, an engagement end, and side edges adapted to engage mating profiles formed in the longitudinally disposed slots, the mating profiles comprising ramp surfaces which present a tapered incline in the range of 2 to 10 degrees with respect to the slot lower edge surface whereby the slots form guideways for the slips for shifting the slips upwardly and outwardly between a set position engaging the circumscribing conduit and an unset position, at least one of the slip forward ends being tapered to a point to facilitate alignment of the slips within the longitudinal slots, the cone segments being initially separated from the slips by a distance at least equal to the length of the slips by a distance at least equal to the length of the slips from the forward ends to the engagement ends thereof;

setting means for effecting opposite relative motion between the cone segments and the slips; and wherein each slip has an arcuate lower surface as defined radially from the longitudinal axis of the cylindrical conduit and wherein an imaginary center line can be drawn which bisects the lower surface longitudinally, the lower surface center line being disposed above the cylindrical conduit exterior surface in both the set and unset positions, wherein movement of the slips upwardly and outwardly relative to the cone segments within the longitudinally disposed slots serves to impose circumferential loading upon the adjacent cone segment side edges.

7. A slip gripping mechanism for supporting a cylindrical conduit within the interior bore of a circumscribing conduit in a well bore, the cylindrical conduit being made up of a plurality of joints of pipe, at least one of the joints having a cylindrical external diameter which defines a length between a threaded connecting end at one extent and an opposite threaded connecting end at another extent, the slip gripping mechanism comprising:

a cone retaining ring having an internal bore, the bore being sized to slidingly receive the cylindrical external diameter of one of the joints of the cylindrical conduit which is to be supported from the circumscribing conduit whereby the cone retaining ring is received directly on the cylindrical external diameter of the cylindrical conduit between the threaded connecting ends thereof;

a plurality of individual cone segments, each cone segment having a forward end, side edges with lower edge surfaces, and an engagement end, the engagement end being adapted to be engaged by the cone retaining ring for supporting each of the cone segments in spaced circumferential locations on the cylindrical conduit, the side edges of adjacent cone segments defining a plurality of circumferentially spaced, longitudinally disposed slots, at least one of the cone segment forward ends being tapered to a point;

a plurality of circumferentially spaced, vertically shiftable slips carried on the cylindrical conduit in the longitudinally disposed slots, each slip having a forward end, an engagement end, and side edges adapted to engage mating profiles formed in the longitudinally disposed slots, the mating slots comprising ramp surfaces which present a tapered incline in the range of 2 to 10 degrees with respect to the slot lower edge surfaces whereby the slots form guideways for the slips for shifting the slips upwardly and outwardly between a set position engaging the circumscribing conduit and an unset position, at least one of the slip forward ends being tapered to a point to facilitate alignment of the slips within the longitudinally disposed slots, the cone segments being initially separated from the slips by a distance at least equal to the length of the slips from the forward ends to the engagement ends thereof;

setting means for effecting opposite relative motion between the cone segments and the slips; and wherein each slip has an arcuate lower surface as defined radially from the longitudinal axis of the cylindrical conduit and wherein an imaginary center line can be drawn which bisects the lower surface longitudinally, the lower surface center line being disposed above the cylindrical conduit exterior surface in both the set and unset positions, wherein movement of the slips upwardly and outwardly relative to the cone segments within the longitudinally disposed slots serves to impose circumferential loading upon the adjacent cone segments.

8. The slip gripping mechanism of claim 7, wherein the slip arcuate upper surfaces have a smaller radius, as defined radially from the longitudinal axis of the cylindrical conduit, than the radius which defines the internal diameter of the circumscribing conduit, to thereby allow the slips to flex and conform to the diameter of the circumscribing conduit as the slips move to the set position.

9. The slip gripping mechanism of claim 8, wherein one of the forward ends of the cone segments is tapered and wherein all of the forward ends of the slips are tapered.

10. A method of supporting a cylindrical conduit within the interior bore of a circumscribing conduit in a well bore by means of a slip gripping mechanism, comprising the steps of:

supporting a plurality of individual cone segments in spaced circumferential fashion at one axial location on the exterior of the cylindrical conduit, each cone segment being provided with a forward end and side edges, the side edges of adjacent cone segments defining a plurality of circumferentially spaced, longitudinally disposed slots;

providing a plurality of circumferentially spaced, vertically shiftable slips carried on the cylindrical conduit and initially spaced-apart form the cone segments, each slip having a forward end and side edged, the side edges being adapted to engage mating profiles formed in the longitudinally disposed slots whereby the slots form guideways for the slips for shifting the slips upwardly and outwardly between a set position engaging the circumscribing conduit and an unset position;

providing setting means for effecting opposite relative motion between the cone segments and the slips;

lowering the cylindrical conduit until the slip gripping mechanism is at the desired depth;

rotating the cylindrical conduit to enable actuation of the setting means;

moving the cylindrical conduit in an axial direction to carry out other well bore operations without bringing the slips into contact with the cone segments; and thereafter actuating the setting means to move the slips into the longitudinally disposed slots and set the slips to engage the circumscribing conduit.

11. The method of claim 10, further comprising the steps of:

providing indexing means on a selected one of said cone segments and said slips to facilitate alignment of said slips within said longitudinally disposed slots upon actuation of said setting means.

12. The method of claim 11, further comprising the steps of:

connecting a drag spring assembly to the, the drag spring assembly having a lower extent and a plurality of drag springs which make frictional contact with the interior bore of the circumscribing conduit as the gripping mechanism is run into position within the well bore; and providing an actuator sleeve mounted on the cylindrical conduit below the drag spring assembly, a selected one of the drag spring assembly and the actuator sleeve being provided with a J-pin, the other of the drag spring assembly and the actuator sleeve being provided with a mating J-slot, whereby movement of the J-pin within the J-slot controls the longitudinal movement of the slips between the retracted and the extended gripping position.

13. The method of claim 12, wherein the cylindrical conduit is first lowered to the desired depth in the well bore, followed by:

rotating the cylindrical conduit to free the slips from the J-slot;

moving the cylindrical conduit in an axial direction to carry out other well bore operations without bringing the slips into contact with the cone segments; and thereafter moving the cylindrical conduit a greater distance axially to move the slips into the longitudinally disposed slots and set the slips to engage the circumscribing conduit.

* * * * *